US006691432B2

(12) United States Patent
Masseron

(10) Patent No.: US 6,691,432 B2
(45) Date of Patent: Feb. 17, 2004

(54) INTERMEDIARY SOLE AND SHOE EQUIPPED WITH SUCH A SOLE

(75) Inventor: Benoît Masseron, Annecy le Vieux (FR)

(73) Assignee: Salomon S.A., Metz-Tessy (FR)

( * ) Notice: Subject to any disclaimer, the term of this patent is extended or adjusted under 35 U.S.C. 154(b) by 78 days.

(21) Appl. No.: 10/042,219

(22) Filed: Jan. 11, 2002

(65) Prior Publication Data

US 2002/0092202 A1 Jul. 18, 2002

(30) Foreign Application Priority Data

Jan. 12, 2001 (FR) ..... 01 00557

(51) Int. Cl.[7] ..... A43B 13/18; A43B 13/14

(52) U.S. Cl. ..... 36/28; 36/30 R; 36/31; 36/37; 36/141

(58) Field of Search ..... 36/28, 30 R, 30 A, 36/31, 35 R, 37, 141

(56) References Cited

U.S. PATENT DOCUMENTS

| | | | | | |
|---|---|---|---|---|---|
| 1,559,532 | A | * | 10/1925 | Smith | 36/28 |
| 1,724,349 | A | * | 8/1929 | Haag | 36/37 |
| 1,785,410 | A | * | 12/1930 | Gilkerson | 36/17 R |
| 1,868,041 | A | * | 7/1932 | Avery | 36/30 A |
| 2,930,149 | A | * | 3/1960 | Hack et al. | 36/28 |
| 3,722,113 | A | | 3/1973 | Birkenstock | 36/11.5 |
| 3,757,774 | A | * | 9/1973 | Hatuno | 601/28 |
| 3,834,046 | A | | 9/1974 | Fowler | 36/28 |
| 4,112,599 | A | | 9/1978 | Krippelz | 36/11.5 |
| 4,271,606 | A | | 6/1981 | Rudy | 36/29 |
| 4,391,048 | A | | 7/1983 | Lutz | 36/28 |
| 4,398,357 | A | * | 8/1983 | Batra | 36/30 A |
| 4,535,553 | A | | 8/1985 | Derderian et al. | 36/28 |
| 4,674,203 | A | * | 6/1987 | Goller | 36/44 |
| RE33,066 | E | * | 9/1989 | Stubblefield | 36/30 R |
| 5,079,856 | A | | 1/1992 | Truelsen | 36/25 R |
| 5,222,311 | A | * | 6/1993 | Lin | 36/28 |
| 5,322,056 | A | | 6/1994 | Menghi et al. | 601/136 |
| 5,369,896 | A | * | 12/1994 | Frachey et al. | 36/29 |
| 5,400,526 | A | * | 3/1995 | Sessa | 36/3 B |
| 5,488,786 | A | | 2/1996 | Ratay | 36/44 |
| 5,493,791 | A | | 2/1996 | Kramer | 36/28 |
| 6,041,521 | A | | 3/2000 | Wong | 36/28 |
| 6,125,557 | A | | 10/2000 | Brown | 36/144 |
| 6,425,194 | B1 | * | 7/2002 | Brie | 36/43 |

FOREIGN PATENT DOCUMENTS

| | | |
|---|---|---|
| EP | 0092366 | 10/1983 |
| EP | 0578618 | 1/1994 |

* cited by examiner

*Primary Examiner*—M. D. Patterson
(74) *Attorney, Agent, or Firm*—Greenblum & Bernstein P.L.C.

(57) ABSTRACT

A shoe having an upper and a sole, the sole including a wear sole and an intermediary sole. The intermediary sole includes an upper surface and a bottom surface, a rear zone provided to support the user's heel zone, and a front zone provided to support the user's forefoot zone. In the front zone, the upper surface includes a plurality of top protuberances and the bottom surface includes a plurality of bottom protuberances, each top protuberance of at least one portion of the plurality of top protuberances is vertically aligned with a bottom protuberance so as to constitute shock-absorbing cylindrical studs that are linked to one another only by their central portion.

15 Claims, 8 Drawing Sheets

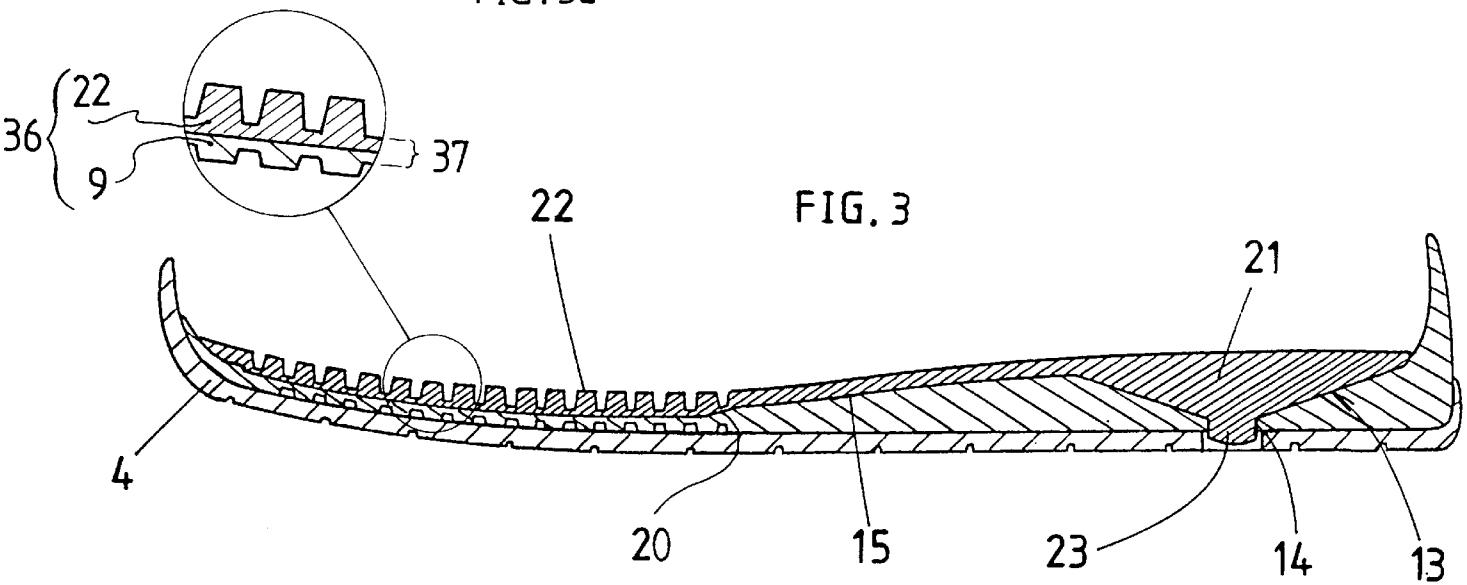
FIG. 3
FIG. 3a
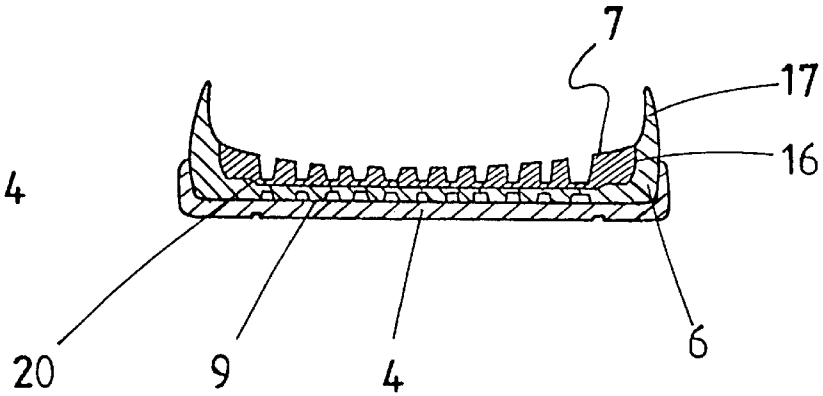
FIG. 4

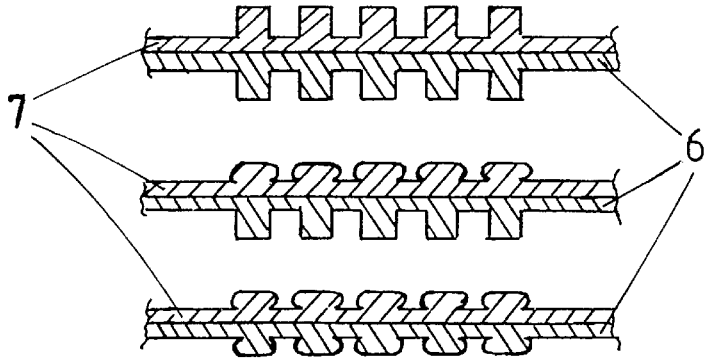
FIG.10a
FIG.10b
FIG.10c
FIG.11
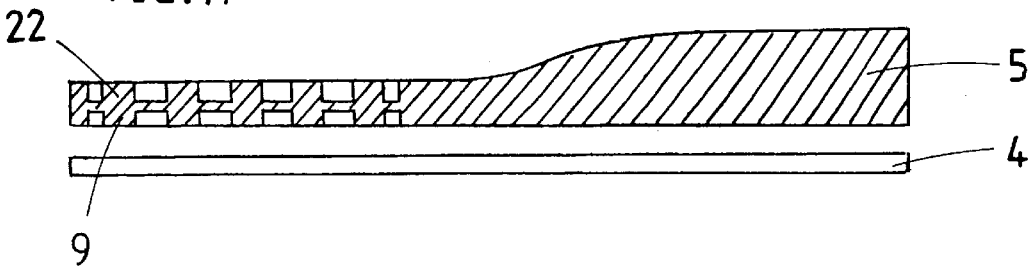
FIG.12
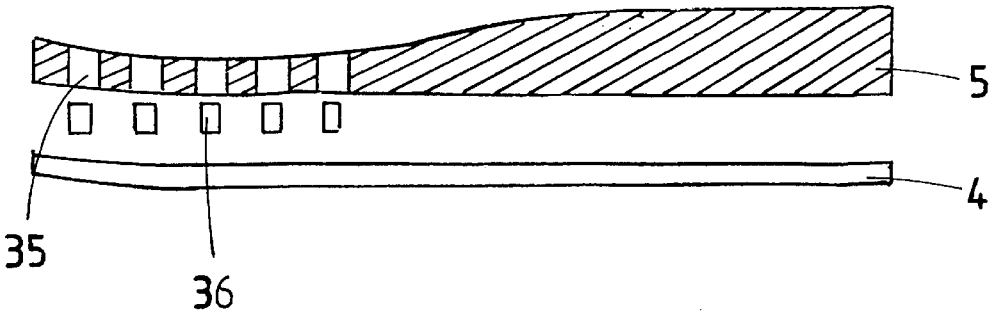

INTERMEDIARY SOLE AND SHOE EQUIPPED WITH SUCH A SOLE

CROSS-REFERENCE TO RELATED APPLICATION

This application is based upon French Patent Application No. 01 00557, filed Jan. 12, 2001, the disclosure of which is hereby incorporated by reference thereto in its entirety, and the priority of which is hereby claimed under 35 U.S.C. §119.

BACKGROUND OF THE INVENTION

1. Field of the Invention

The present invention relates to sports shoes that have shock-absorbing soles.

2. Description of Background and Relevant Information

In many sports, the human body and, more particularly, the lower limbs, are subjected to substantial forces. A typical example of substantial forces to which the lower limbs are subjected occurs during jump landings. As the athlete touches the ground, his/her feet are subjected to a reaction of the ground that is as substantial as the jump is high. The human foot has a fleshy zone beneath the heel, whose role is to absorb the impacts to which the heel is subjected. This natural shock absorption is insufficient, and it is known to equip the shoes, especially sports shoes, with shock-absorbing devices.

In certain sports, such as skateboarding, jumps sometimes have ranges of several meters and the landings are generally performed on a hard and flat ground. Moreover, it is not advisable to provide a substantial shock absorption in the area of the board and trucks, because it is due to their rigidity that certain figures are possible. Consequently, the problem of shock-absorbing soles for the skateboard shoes has a different scope than that of more conventional sports shoes. Nevertheless, in a sport such as skateboarding, some of the movements are acrobatic and the rider must remain in constant contact with his/her environment. In particular, the feet, which rest on the board most of the time, must precisely inform the rider about his/her position in relation to the board and in space. This is why the sole of a sports shoe, such as a skateboard shoe, not only must absorb the impacts, but it must also transmit a certain amount of information to the rider, such as his/her position in space, including, for example, his/her position on the board.

SUMMARY OF THE INVENTION

The invention relates more particularly to skateboard shoes, and an object of the invention, among other things, is to enable a progressive and channeled shock absorption during landing from high and low jumps.

Furthermore, an additional object of the invention is to provide an increased sensation in the metatarsophalangeal bending zone, while preserving the shock absorption functions of a conventional product.

The object of the invention is achieved in that the intermediary sole is constructed of a plurality of parts and includes shock-absorbing structures that are only partially linked to one another, such that a relative movement of these shock-absorbing structures in the vertical direction, in relation to the intermediary sole, on the one hand, and in relation to one another, on the other hand, is possible.

In one of the embodiments of the invention, the shock-absorbing structures are cylindrical studs that are adapted to have a vertical movement with respect to one another.

In one embodiment of the invention, the shock-absorbing structures are cylindrical studs whose axis is vertical, or substantially vertical. These studs are not completely independent from one another but are partially connected, at only one portion of their lateral surface, to the intermediary sole. The studs are then constituted by an upper protuberance, a lower protuberance, and a central portion which connects the upper and lower protuberances to one another, on the one hand, and the studs to one another, on the other hand. The portion of the intermediary sole that connects the studs to one another by their central portion is called the core and is thin in order to facilitate the movement of the studs with respect to one another.

In another embodiment of the invention, the intermediary sole is made of a plurality of parts and includes two half-soles, or partial-soles: the lower, or bottom, intermediary half-sole, which is commonly referred to as the cup, and the upper, or top, intermediary half-sole, also called the insert. In this embodiment, the shock-absorbing structures of the intermediary sole include cylindrical studs, each of the latter being constituted by an upper protuberance connected by its base to the upper surface of the insert and by a lower protuberance connected by its base to the bottom surface of the cup. Such studs are arranged in the entire front zone, and more particularly in the metatarsophalangeal bending zone. These studs have a certain freedom of movement with respect to one another, and with respect to the remainder of the intermediary sole. The upper half-sole, or insert, therefore includes, in the metatarsophalangeal zone, an upper half-core from which upper protuberances project, whereas the lower half-sole includes a lower half-core from which lower protuberances project downward. When the two half-soles are assembled, each upper protuberance is aligned with a lower protuberance, thus defining the juxtaposed studs and having a certain vertical and rotational freedom of movement with respect to one another. Thus, the more precise and greater number of sensations are transmitted to the athlete from the surface on which he/she moves. Moreover, the material of the upper intermediary half-sole is less dense than the material of the lower half-sole so that shock absorption is progressive, and that comfort is ensured during walking and when performing low jumps, on the one hand, and landing from jumps several meters high, on the other hand.

An object of the invention is also achieved in that the intermediary sole includes two portions, each of which is made of a different material. Preferably, one of the materials is less dense than the other. The upper intermediary half-sole further includes a conical shape whose apex is oriented downwardly. This shape is nested in the bottom intermediary half-sole, which includes a complementary concave shape. Furthermore, this concave shape is extended by a vertical well. Thus, under the effect of an impact, the softer material of the upper intermediary half-sole is channeled by the walls of the concave shape until it can flow out of this shape by the vertical well connected to the bottom of the latter.

Preferably, the difference in density between the material of the upper intermediary half-sole and that of the lower intermediary half-sole is such that during landing from a high jump, the compression of the lower intermediary half-sole begins to occur before that of the upper intermediary half-sole reaches its limits. The density of the upper intermediary half-sole is selected such that the shoe is comfortable during normal use, and that shock absorption is ensured during walking and low jumps; this material is relatively flexible. The material of the lower intermediary half-sole is more rigid so as to ensure shock absorption even when landing from a jump several meters high.

BRIEF DESCRIPTION OF DRAWINGS

The invention will be better understood from the description that follows, with reference to the annexed drawings, in which:

FIG. 3 shows a longitudinal cross section of the sole of the shoe described in FIG. 1;

FIG. 3*a* is a partial enlargement of FIG. 3;

FIG. 4 shows a transverse cross section of the sole of the shoe described in FIG. 1;

FIGS. 10*a*, 10*b*, 10*c* schematically show the behavior of the front portion of the sole according to the first embodiment of the invention;

FIG. 11 shows a second embodiment of the invention;

FIG. 12 shows a third embodiment of the invention;

DETAILED DESCRIPTION OF THE INVENTION

Figure 1:
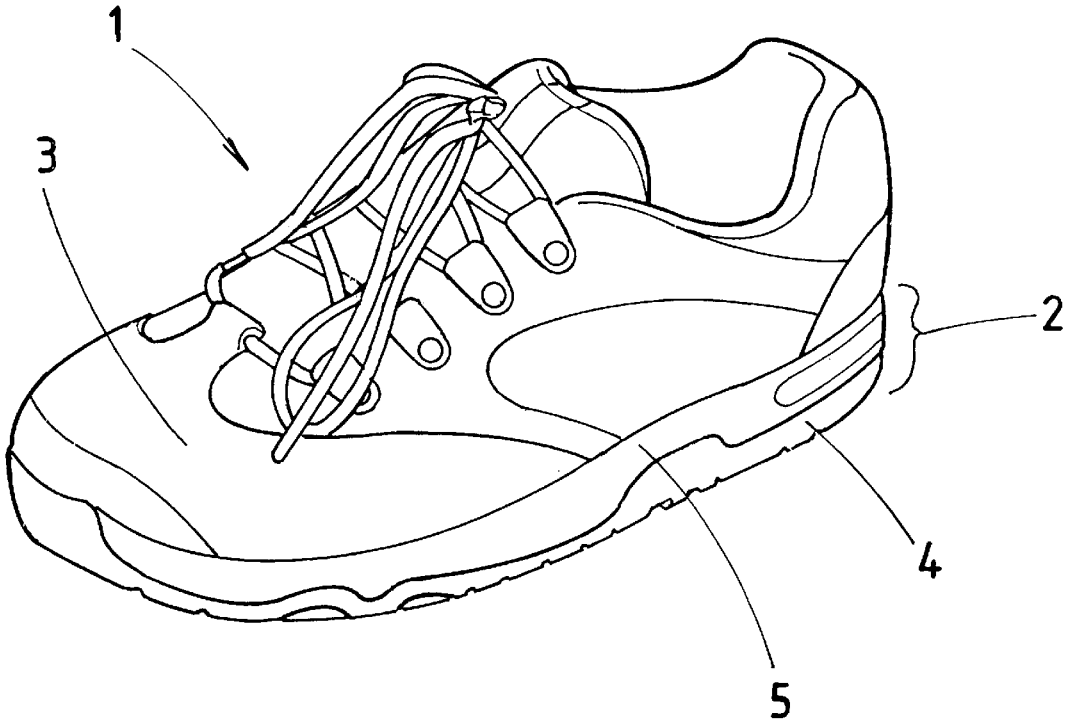
FIG. 1 shows a sports shoe according to a first embodiment of the invention.

FIG. 1 shows a side view of a sports shoe 1 particularly adapted to skateboarding. It includes an upper 3 beneath which a sole 2 is fixed. The sole 2 includes an intermediary sole 5 whose function is to ensure the comfort of the foot, and a wear sole 4 that is made of a material having a good adherence property and a very good abrasion resistance. The upper is sewn on a flexible sole called a strobel insole, the assembly constituted of the upper 3 and of this strobel insole is cemented to the sole 2, thus forming the shoe 1.

Figure 2:
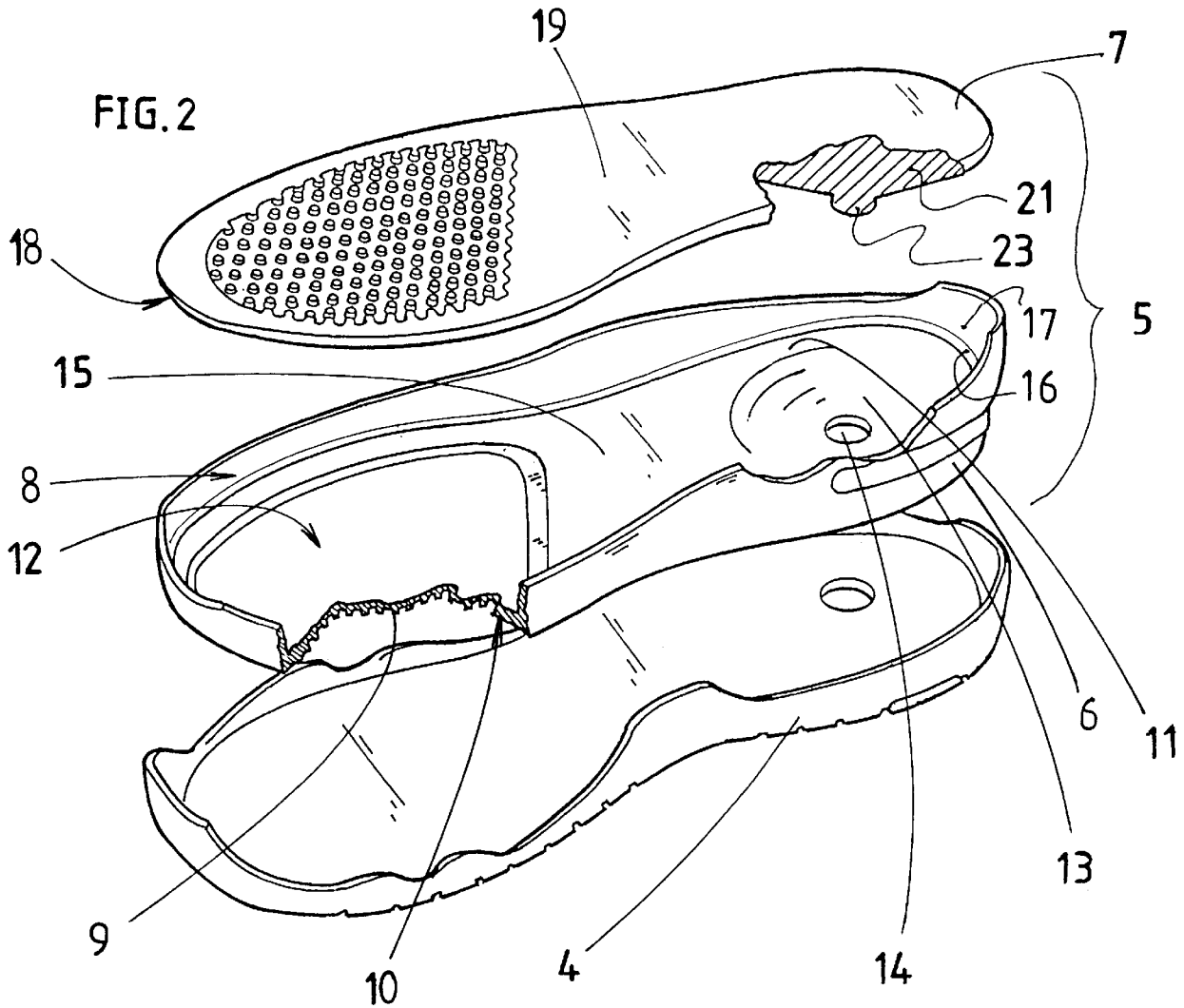
FIG. 2 shows a perspective partial and exploded view of the shoe of FIG. 1.

FIG. 2 shows a perspective exploded view of the sole 2. The intermediary sole 5 includes a bottom intermediary half-sole, or partial-sole, 6 and a top intermediary half-sole, or partial-sole 7.

The bottom half-sole or cup 6 includes a bottom surface 10 which comes into contact with the wear sole, and a top surface 11 which comes into contact with the top intermediary half-sole 7. The periphery of the cup 6 is constituted of substantially vertical edges 8. In its front portion, the bottom surface 10 of the cup 6 has a plurality of bottom protuberances 9. The bottom protuberances 9 are cylindrical, or substantially cylindrical, and project downwardly from the cup 6. They are uniformly arranged over the entire front portion of the bottom surface 10 of the cup 6. The arrangement of the bottom protuberances 9 is carried out according to a pattern whose first direction is oriented substantially along the longitudinal axis of the shoe. The second direction of the pattern forms, together with the first, an angle that is comprised between 60° and 80°, or about 60° and 80°. The bottom protuberances 9 have a cylindrical shape with a diameter comprised between 4 and 6 millimeters (mm), and project by a distance comprised between 1.5 and 3 mm, or between about 1.5 mm and about 3 mm. The distance between two adjacent bottom protuberances 9 is comprised between 1 mm and 5 mm, or between about 1 mm and about 5 mm. Preferably, this distance is approximately equal to 2 mm.

Except for a peripheral band, the bottom protuberances 9 are present over the entire front portion of the bottom surface 10 of the cup 6.

The top surface 11 of the cup 6 has an edge 8 at its periphery. It includes a depression 12 in substantially the entire front zone; this depression 12 corresponds to the front zone of the bottom surface 10 of the cup 6 where the bottom protuberances 9 are arranged. Thus, exclusive of the height of the protuberances, the cup 6 is the thinnest in the area of this depression 12.

In the heel area, the top surface 11 includes a cavity 13 having substantially the shape of an inverted truncated cone at the bottom of which a well 14 extending through the cup 6 is arranged. Because the cup 6 is substantially thicker in its heel portion than in the front portion, the top surface thereof also includes an inclined portion 15 connecting the depression 12 to the cavity 13.

The edge 8 includes a lower belt 16 overlaid by an upper belt 17. The lower belt 16 makes it possible to embed the top intermediary half-sole 7, whereas the upper belt 17 is adhered to the upper during assembly of the shoe.

The top intermediary half-sole includes a lower surface 18 and an upper surface 19. The lower surface 18 is complementary to the top surface of the cup. Thus, in the front portion a projecting slab 20 which conforms to the shape of the depression 12 is arranged.

The heel portion includes a dome 21 oriented downwardly, which is extended at its end by a nipple 23. The upper surface 19 has, in its front portion, a depressed area whose peripheral contour corresponds to the projecting slab 20 present on the lower surface 18. As mentioned previously, in a preferred embodiment the top intermediary partial-sole is more flexible than the bottom intermediary-sole. Thus, according to a preferred embodiment, the dome of the top intermediary partial-sole is more flexible than the rear zone of the bottom intermediary partial-sole. Also, as shown in the partial cut-away detail in FIG. 2, the dome 21 is made in one piece and is solid in horizontal cross section along the height of the dome. surface 18.

From the bottom of this depressed area, a plurality of top protuberances 22 project upwardly. The arrangement of these top protuberances 22 is carried out along a pattern, one direction of which corresponds substantially to the longitudinal axis of the shoe, whereas the other direction forms, together with the latter, an angle that is comprised between 60° and 80°, or approximately between 60° and 80°. The top protuberances 22 have a generally cylindrical shape whose diameter is comprised between 4 mm and 6 mm, or approximately therebetween. Their height is not uniform over the entire area of the upper surface 19. In the central zone, i.e., in a zone located in the vicinity of the longitudinal axis, the protuberances have a height comprised between 2 and 4 mm. In the peripheral zones, on the other hand, the height of the protuberances is comprised between 4 and 6 mm.

Now it is advisable to see how the various elements constituting the sole are assembled with one another and how they interact. In a known fashion, the three elements, viz., wear sole 4, cup 6, and top intermediary half-sole are adjusted and then cemented. The complementarity of the shapes of the top surface 11 and of the lower surface 18 facilitates the adjusting and ensures greater efficiency during cementing.

FIG. 3 shows a longitudinal cross-section of the assembled sole, and FIG. 3*a* is a partial enlargement of FIG. 3. Each bottom protuberance 9 is in vertical alignment with a top protuberance 22. Thus, with this superimposition, a plurality of studs 36 constituted by a top protuberance 22 and a bottom protuberance 9 are defined. The latter are connected to one another only by their central portion 37, which includes one portion extending from the top half-sole and another extending from the bottom half-sole. The overall shock absorption of the front portion of the sole is ensured by the juxtaposition of these cylindrical studs 36. During a jump landing, the pressure exerted on the sole by the foot is substantially uniformly distributed, and all these cylindrical studs have a similar behavior, i.e., all of them are going to be subject to a compression that is proportional to the pressure.

If, on the other hand, the sole is subjected to a force that is not uniformly distributed over its entire surface, the behavior will not be similar in all areas. The response of the sole to the bias will be precisely limited to the areas where the force is exerted.

Figure 5:
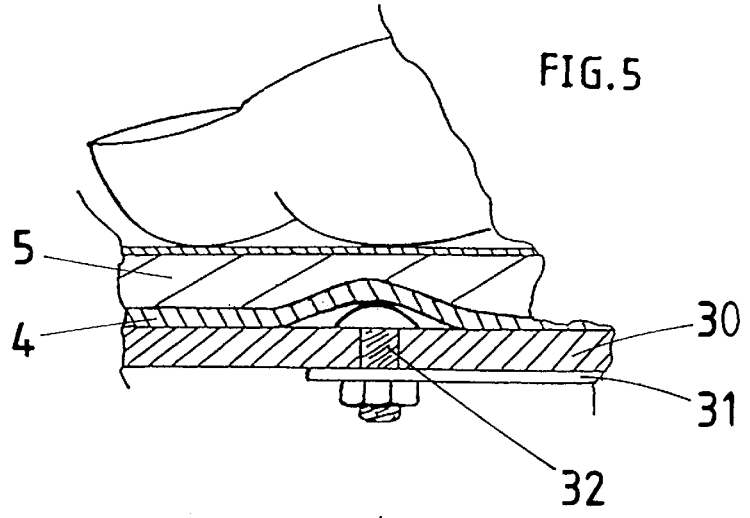
FIGS. 5 and 6 show the behavior of two shock-absorbing soles according to the prior art.
Figure 6:
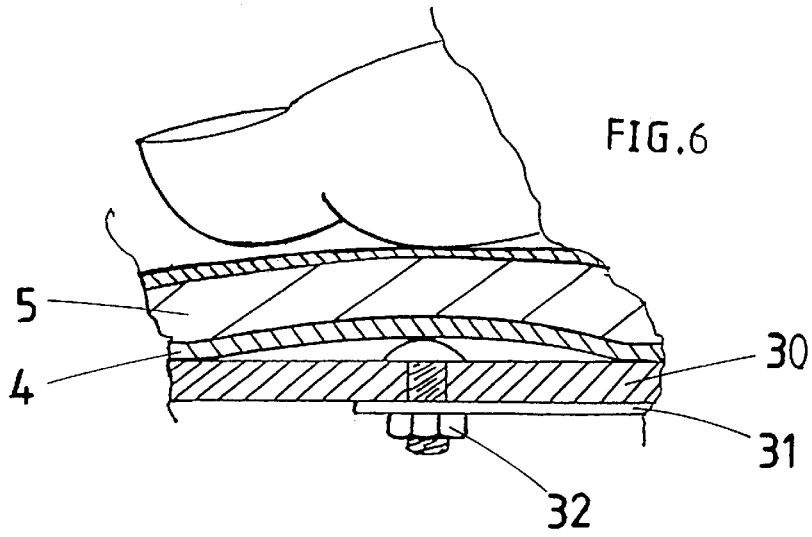
Figure 7:
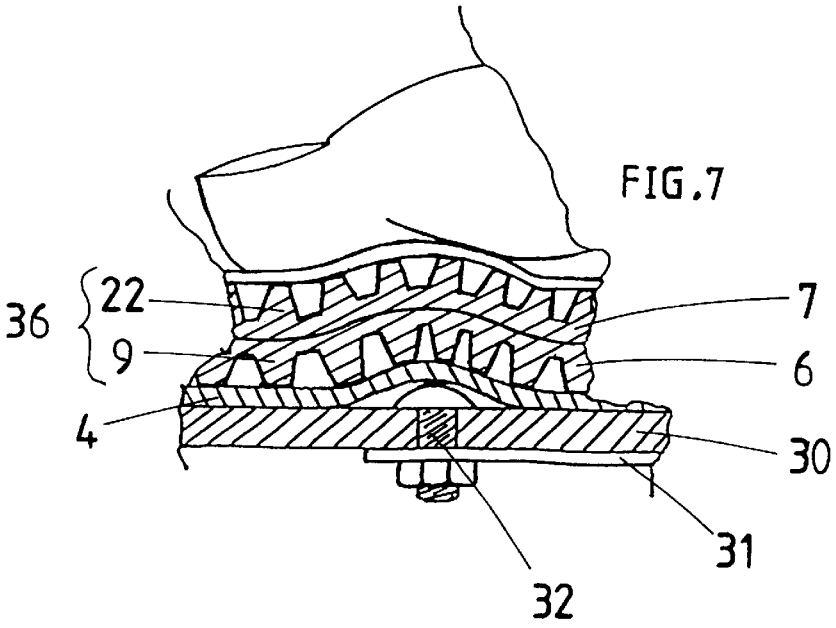
FIG. 7 schematically shows the behavior of the sole according to the first embodiment of the invention.

FIGS. 5, 6, 7 show a comparison between the behavior of the sole according to the invention and the behavior of two soles according to the prior art.

FIG. 5 schematically shows the behavior of a sports shoe sole positioned on a skateboard 30 having a screw 32 for binding the trucks 31, whose head projects from the board. The intermediary sole 5, which is made out of a very soft material to ensure a good shock absorption, is compressed in the area of the screw head without the upper surface thereof becoming deformed. With such a sole, no information is transmitted to the athlete from the surface with which he/she is in contact.

FIG. 6 also schematically shows the behavior of a sole according to the prior art in the same situation. The material of the intermediary sole is more rigid and the projection made by the screw head generates a buckling of the entire sole. In this case, the information transmitted from the board to the athlete is very inaccurate, and the user cannot determine his/her exact position on the board by relying on his/her sensations alone. This type of sole somewhat smoothes or dissipates the information.

FIG. 7 shows the behavior of the sole according to the invention. Due to the relative independence of the studs with respect to one another, the sole becomes deformed only in the area located at the screw head. Thus, the athlete is able to determine precisely how he/she is positioned in relation to the screw in question. Similarly, when his/her foot is positioned on the edge of the board, the athlete can precisely feel the contour line thereof.

Figure 8A:
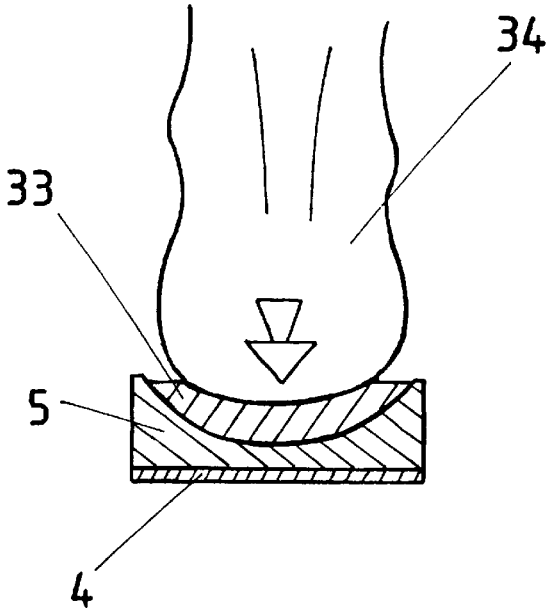
FIGS. 8*a*, 8*b*, 8*c* show the behavior of a shock absorbing sole according to the prior art, at rest and when it is subject to more or less strong impacts.
Figure 8B:
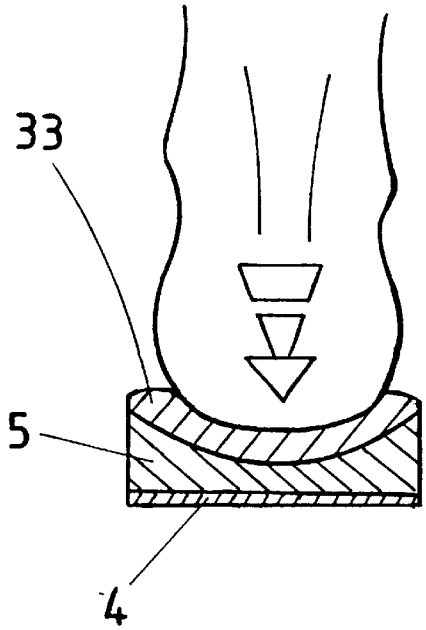
Figure 8C:
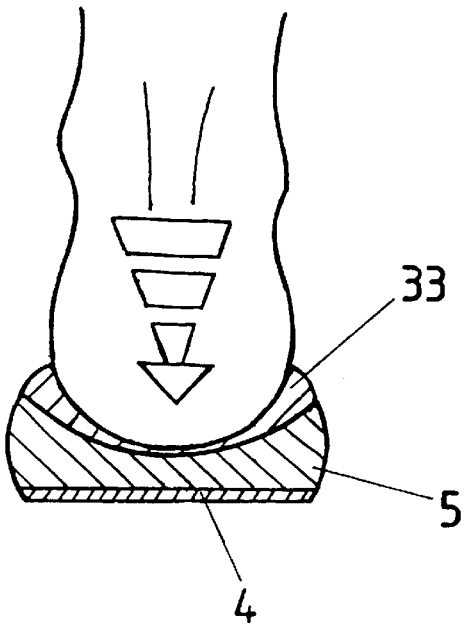

FIGS. 8*a*, 8*b*, and 8*c* show the behavior of an intermediary sole whose heel portion includes an insert 33 made of foam or gel, having a higher absorption coefficient than the remainder of the sole.

FIG. 8*a* shows the situation at rest. The foot 34 is slightly sunk into the insert 33.

FIG. 8*b* shows the situation of the sole during landing from short range jumps. The insert 33 perfectly fulfills its role and the impact is absorbed.

In the case of longer range jumps, FIG. 8*c*, the material of the insert flows laterally under the violence of the impact, and there is a sudden variation in the absorption of the impact. Initially, the shock absorption is ensured by the insert 33. Secondly, the latter is obtained by the intermediary sole. Finally, a bottoming phenomenon occurs, during which the heel no longer benefits from any shock absorption.

Figure 9A:
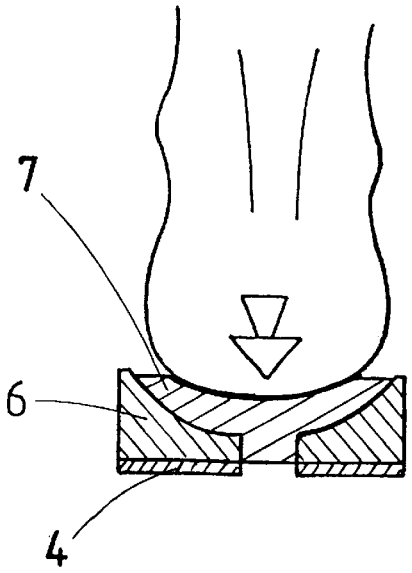
FIGS. 9*a*, 9*b*, 9*c*, respectively, show the behavior of a sole according to the first embodiment of the invention, under the same conditions as in the preceding figures.
Figure 9B:
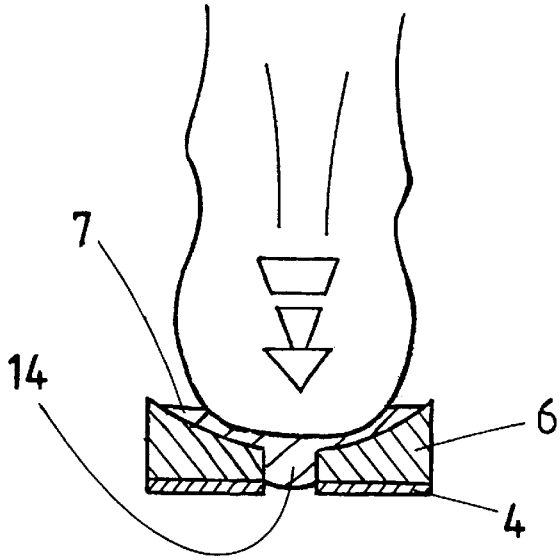
Figure 9C:
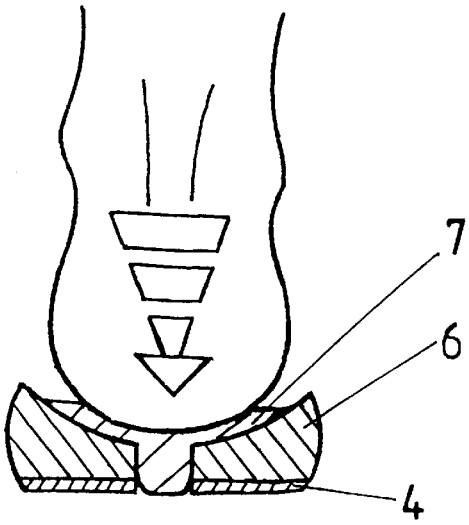

FIGS. 9*a*, 9*b*, and 9*c* show the behavior of a sole according to the invention under the same conditions. At rest (FIG. 9*a*), as well as during a small impact (FIG. 9*b*), the behavior of the sole is almost similar to that of a sole having an insert according to the prior art. However, during very violent impacts (FIG. 9*c*), the flow does not occur only laterally, but partly by the well 14. Thus, even when the shock absorption is at its height, the lower portion of the heel benefits from the shock absorption of the top half-sole. In this regard, the well 14 plays a key role. If it were not present, the material of the top half-sole would be compressed to the maximum, and the bottoming phenomenon would occur much more quickly. Bottoming occurs when, under the effect of a very strong impact, the intermediary sole has reached its maximum limit of compression and, for the heel, it is as if there were no longer any shock absorption.

FIGS. 10*a*, 10*b*, and 10*c* show the functioning of the progressive shock absorption of the front portion of the sole.

In FIG. 10*a*, the sole is at rest, the top and bottom protuberances are slightly compressed or not compressed. During low jump landings (FIG. 10*b*), only the top protuberances, which are made of a flexible material, are compressed. If the jump is high (FIG. 10*c*), the bottom protuberances, made of a more rigid material, are also compressed.

FIG. 11 shows a second embodiment of the invention in which the intermediary sole 5 is made in one piece. In the front portion thereof, especially beneath the metatarsophalangeal bending zone, two recessed zones face one another, one on top, the other at the bottom. The top recessed zone is equipped with top protuberances 22, whereas the bottom recessed zone is equipped with bottom protuberances 9. Given that each of the bottom protuberances is vertically aligned with a top protuberance, studs are thus constituted, which participate in the shock absorption function of the intermediary sole while having a certain freedom of movement, especially vertical, with respect to one another.

FIG. 12 schematically shows a shoe sole according to a third embodiment of the invention. The intermediary sole 5 includes holes 35 in which studs are inserted. As in the two previously described embodiments, the studs are arranged over a major portion of the front zone of the sole, especially that corresponding to the metatarsophalangeal bending zone.

Figures 13, 13A:
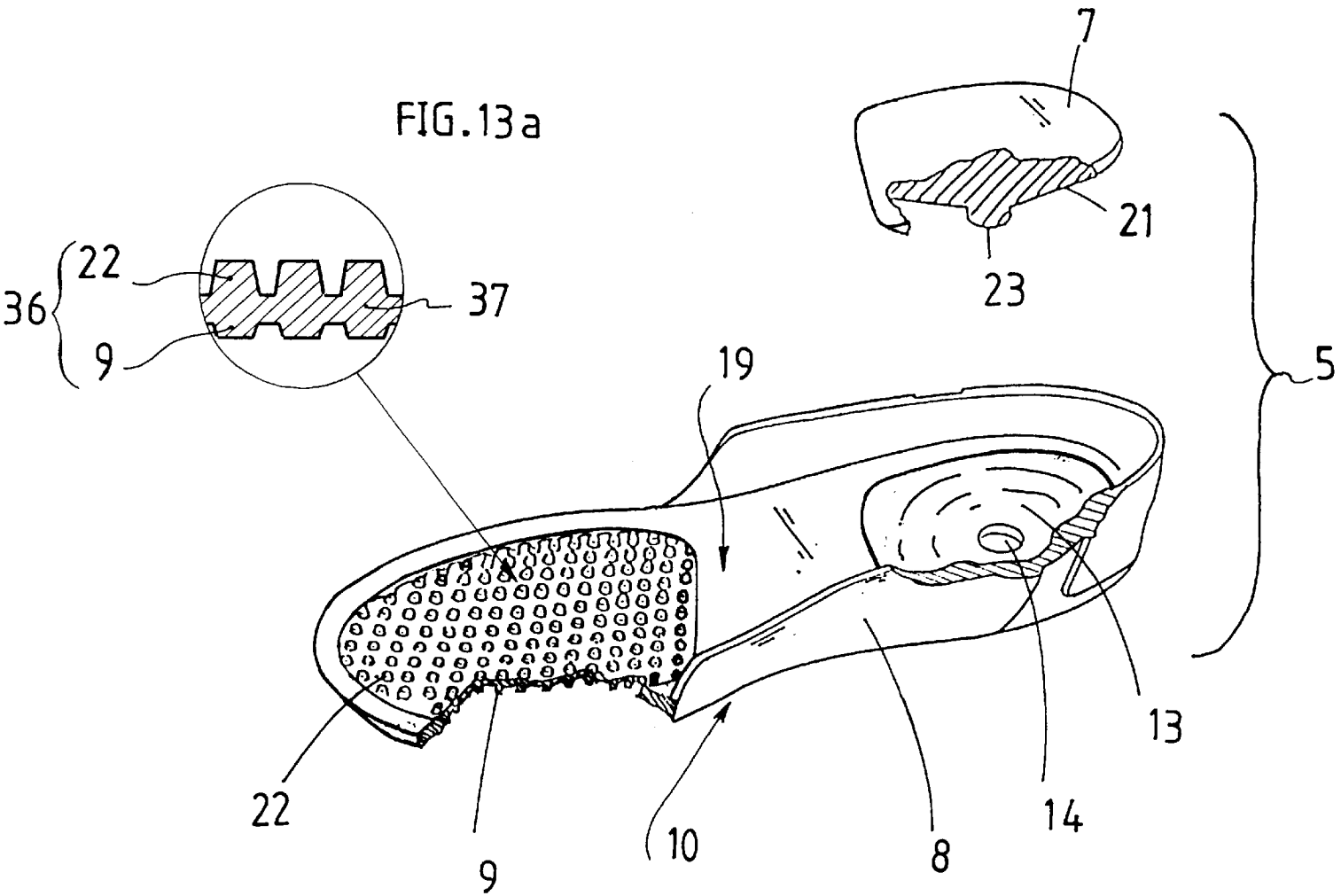
FIG. 13 shows a fourth embodiment of the invention.
FIG. 13*a* is a partial enlargement of FIG. 13.

FIG. 13 shows a fourth embodiment of the invention in which the front portion is similar to the embodiment described in FIG. 11. Thus, the entire front portion of the intermediary sole is in one piece, whereas the top intermediary half-sole is reduced to an insert 7 supporting the heel. According to the invention, and as is shown in FIG. 13*a*, the studs 36 are constituted of a top protuberance 22, a bottom protuberance 9, and a central portion 37 which ensures the linkage of the studs with one another. The rear portion of the bottom intermediary half-sole includes a cavity 13 having a generally conical shape complementary to that of the insert 7. As mentioned previously, this conical shape, associated with the presence of a well 14, enables the material of the insert 7 to flow in the cavity 13 and the well 14.

The invention is not limited to the few particular embodiments described by way of examples, and many other embodiments can be envisioned without leaving the scope of the invention. Thus, one can provide that the holes 35 described in FIG. 12 be blind and do not extend completely through the sole. In parallel, the shock absorption/sensitivity compromise can also be obtained from a conventional, i.e., integral and protuberance-free intermediary sole, in which non-through notches are made.

NOMENCLATURE

1—shoe
2—sole
3—upper
4—wear sole
5—intermediary sole
6—bottom intermediary half-sole or cup
7—top intermediary half-sole or insert
8—edge

9—bottom protuberance
10—bottom surface
11—top surface
12—depression
13—cavity
14—well
15—inclined portion
16—lower belt
17—upper belt
18—lower surface
19—upper surface
20—projecting slab
21—dome
22—top protuberances
23—nipple
30—skateboard
31—truck
32—binding screw
33—insert
34—heel
35—hole
36—stud
37—central portion

What is claimed is:

1. A shoe comprising:

an upper;

a sole underlying said upper, said sole including a wear sole and an intermediary sole, said intermediary sole comprising:

an upper surface and a bottom surface;

a rear zone for supporting a user's heel zone;

a front zone for supporting the user's forefoot zone;

in said front zone, said upper surface includes a plurality of top protuberances and said bottom surface includes a plurality of bottom protuberances, each top protuberance of at least one portion of said plurality of top protuberances is vertically aligned with a respective one of said bottom protuberances so as to constitute shock-absorbing cylindrical studs linked to one another only by respective central portions;

said intermediary sole further including a top intermediary half-sole including said upper surface and a lower surface, and on which said top protuberances are arranged, and a bottom intermediary half-sole including said bottom surface and a top surface, and beneath which said bottom protuberances are arranged, said lower surface and said top surface being in contact.

2. A shoe according to claim 1, wherein said top intermediary half-sole is more flexible than said bottom intermediary half-sole.

3. A shoe according to claim 1, wherein said vertical extension of said top protuberances is more substantial than the vertical extension of the bottom protuberances.

4. A shoe according to claim 3, wherein said bottom half-sole includes, in said rear zone, a cavity that is extended by a well, and wherein said top intermediary half-sole includes a dome with a shape complementary to that of said cavity.

5. A shoe according to claim 4, the shapes of the cavity and of the dome, which are complementary, are truncated cones.

6. A shoe according to claim 1, wherein said bottom half-sole includes, in said rear zone, a cavity that is extended by a well, and wherein said top intermediary half-sole includes a dome with a shape complementary to that of said cavity.

7. A shoe according to claim 6, wherein the shapes of the cavity and of the dome, which are complementary, are truncated cones.

8. A shoe comprising:

an upper;

a sole underlying said upper, said sole including a wear sole and an intermediary sole, said intermediary sole comprising:

an upper surface and a bottom surface;

a rear zone for supporting a user's heel zone;

a front zone for supporting the user's forefoot zone;

in said front zone, said upper surface including a plurality of top protuberances and said bottom surface including a plurality of bottom protuberances, each top protuberance of at least one portion of said plurality of top protuberances being vertically aligned with a respective one of said bottom protuberances so as to constitute shock-absorbing cylindrical studs linked to one another only by respective central portions;

in said rear zone, said intermediary sole comprising a cavity that is extended by a well and a dome having a shape complementary to that of said cavity.

9. A shoe according to claim 8, wherein said intermediary sole includes a top half-sole limited to an insert positioned in the rear zone of said intermediary sole, said front zone of said intermediary sole in one piece.

10. A shoe according to claim 8, wherein said complementary shapes of the cavity and the dome comprise truncated cones.

11. A shoe comprising:

an upper;

a sole underlying said upper, said sole including a wear sole and an intermediary sole, said intermediary sole comprising:

an upper surface and a bottom surface;

a rear zone for supporting a user's heel zone;

a front zone for supporting the user's forefoot zone;

in said front zone, said upper surface including a plurality of top protuberances and said bottom surface including a plurality of bottom protuberances, each top protuberance of at least one portion of said plurality of top protuberances being vertically aligned with a respective one of said bottom protuberances so as to constitute shock-absorbing cylindrical studs linked to one another only by respective central portions;

said intermediary sole further comprising a top intermediary partial-sole and a bottom intermediary partial-sole, said bottom intermediary partial-sole including, in said rear zone, a cavity that is extended by a well, and said top intermediary partial-sole including a dome positioned within said cavity, said dome having a shape complementary to a shape of said cavity.

12. A shoe according to claim 11, wherein said complementary shapes of the cavity and the dome comprise truncated cones.

13. A shoe according to claim 11, wherein said top intermediary partial-sole is more flexible than said bottom intermediary partial-sole.

14. A shoe according to claim 11, wherein said dome of said top intermediary partial-sole is more flexible than said rear zone of said bottom intermediary partial-sole.

15. A shoe according to claim 14, wherein said dome is made in one piece and is solid in horizontal cross section along a full height of the dome.

* * * * *